United States Patent [19]

Shinzawa et al.

[11] Patent Number: 4,662,172

[45] Date of Patent: May 5, 1987

[54] EXHAUST PURIFICATION APPARATUS

[75] Inventors: Motohiro Shinzawa; Shoji Ushimura, both of Yokosuka, Japan

[73] Assignee: Nissan Motor Company, Ltd., Japan

[21] Appl. No.: 890,969

[22] Filed: Jul. 29, 1986

Related U.S. Application Data

[63] Continuation of Ser. No. 815,276, Dec. 26, 1985, abandoned, which is a continuation of Ser. No. 589,754, Mar. 14, 1984, abandoned.

[51] Int. Cl.[4] ..... F01N 3/02

[52] U.S. Cl. ..... 60/303; 60/738; 431/248

[58] Field of Search ..... 60/303, 286, 274, 738; 431/248

[56] References Cited

U.S. PATENT DOCUMENTS

| | | | |
|---|---|---|---|
| 2,628,475 | 2/1953 | Heath | 60/738 |
| 2,912,825 | 11/1959 | Blackman | 60/738 |
| 4,424,671 | 1/1984 | Tokura | 60/274 |
| 4,459,805 | 7/1984 | Kamiya | 60/311 |

*Primary Examiner*—Douglas Hart

*Attorney, Agent, or Firm*—Lowe, Price, LeBlanc, Becker & Shur

[57] ABSTRACT

An exhaust purification apparatus includes a regenerative burner for repetitively regenerating a trap element located in the exhaust system of an internal combustion engine. The regenerative burner has a combustion chamber adapted to permit flow of exhaust gas from the engine exhaust conduit to the trap element. A hollow member is disposed within the combustion chamber to define an evaporation chamber therein. The hollow member has a side wall formed with a number of flame holes to permit fluid flow from the evaporation chamber into the combustion chamber. The evaporation chamber has a supply of air-fuel mixture through a mixture conduit having an end terminating in a discharge outlet opening into the evaporation chamber. The mixture conduit has a portion extending through the combustion chamber to promote fuel evaporation during a trap regeneration operation.

7 Claims, 4 Drawing Figures

EXHAUST PURIFICATION APPARATUS

This application is a continuation of application Ser. No. 815,276, filed Dec. 26, 1985, which is a continuation of application Ser. No. 589,754 filed Mar. 14, 1984 both now abandoned.

BACKGROUND OF THE INVENTION

This invention relates to an apparatus including a regenerative burner for repetitively regenerating a trap element located in the exhaust system of an internal combustion engine.

It has been proposed to purify exhaust gas from an automobile internal combustion engine by employing a trap or particle filter element located in the exhaust system of the engine to collect therein carbon or other particles included in the exhaust gas discharged from the engine. The trap element should be repetitively regenerated each time a regeneration requirement occurs; that is, when the amount of the exhaust particles collected in the trap element reaches a limit value. For this purpose, a regenerative burner is disposed in the exhaust system upstream of the trap element, the regenerative burner including a glow plug operable to ignite and burn an air-fuel mixture supplied into the burner so as to burn the exhaust particles collected in the trap element when a regeneration requirement occurs.

The regenerative burner has a liner closed at its upstream end by an end plate to define therein a combustion chamber opening toward the trap element. The liner formed in its side wall with a number of holes to permit flow of exhaust gas from the engine exhaust conduit to the trap element. The liner contains a cylindrical cup which is secured at its upstream end on the end plate and which extends into the combustion chamber to define an evaporation chamber therein. The cup has a cylindrical side wall formed with a number of flame holes to permit fluid flow from the evaporation chamber into the combustion chamber. The evaporation chamber has a supply of air-fuel mixture through a mixture conduit which has one end terminating in a discharge outlet extending through the end plate into the evaporation chamber. The air-fuel mixture charged in the evaporation chamber is ignited by a glow plug when a regeneration requirement occurs.

A disadvantage with such an apparatus is that under low speed and low load conditions such for example as idle conditions where the temperature of exhaust gas is relatively low and the amount of fuel required for the regenerative burner is relatively great, the fuel fed through the mixture conduit is not heated to a temperature sufficient to be evaporated completely, resulting in degraded combustion in the regenerative burner. This difficulty stems mainly from the conventional design of the regenerative burner wherein the air-fuel mixed fed through the mixture conduit is preheated only by exhaust gases from the engine.

The present invention provides an improved exhaust purification apparatus which can provide improved burner combustion efficiency to improve trap regeneration efficiency and also creates stable flame in the burner to provide uniform trap regeneration over the entire range of engine operating conditions.

SUMMARY OF THE INVENTION

There is provided, in accordance with the present invention, an exhaust purification apparatus for use in an internal combustion engine having an exhaust conduit through which exhaust particles are discharged together with exhaust gas to the atmosphere. The apparatus includes an outer shell having an inlet connected to the exhaust conduit and an outlet connected to the atmosphere. The outer shell contains a trap element and a regenerative burner located upstream of the trap element.

The regenerative burner comprises a liner fixed to the outer shell to define a combustion chamber. The liner is adapted to permit flow of exhaust gas from the exhaust conduit to the trap element. The liner supports a cup-shaped member which extends into the combustion chamber to define an evaporation chamber therein. The cup has a side wall formed therein with holes or slits to permit fluid flow from evaporation chamber into the combustion chamber.

A mixture conduit has an end terminating in a discharge outlet for supplying air-fuel mixture into the evaporation chamber. The mixture conduit has a portion extending through the conbustion chamber to promote fuel evaporation during a trap regeneration operation. The mixture charged in the evaporation chamber is ignited by a glow plug.

A control unit actuates the glow plug and supplies an air-fuel mixture into the evaporation chamber through the mixture conduit when a regeneration requirement occurs.

BRIEF DESCRIPTION OF THE DRAWINGS

The present invention will be described in greater detail by reference to the following description taken in connection with the accompanying drawings, where like reference numerals refer to the same or corresponding parts, and in which.

DESCRIPTION OF THE PREFERRED EMBODIMENTS

Figure 1:
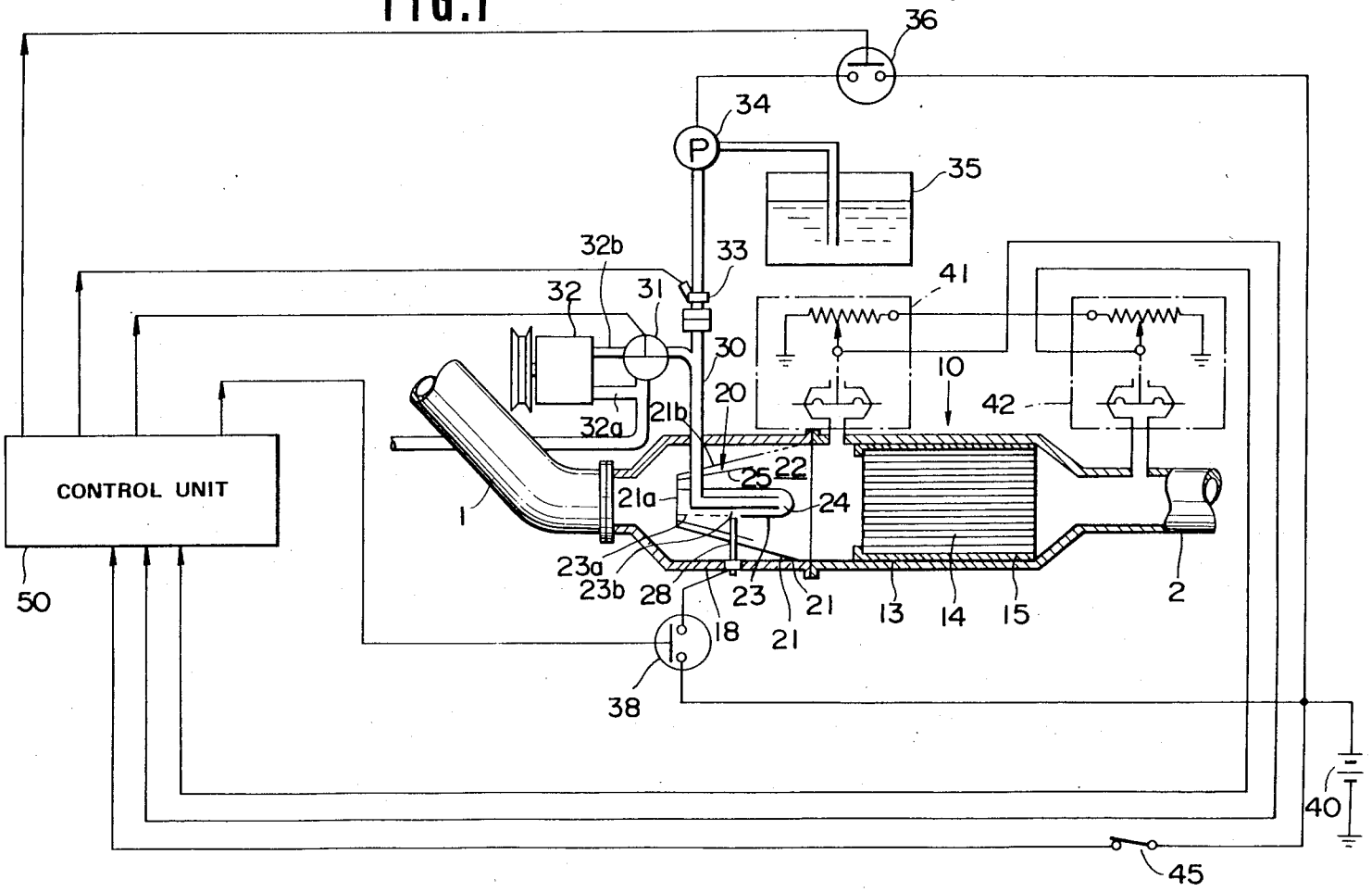
FIG. 1 is a schematic diagram showing one embodiment of an exhaust purification apparatus made in accordance with the present invention.

In the drawings FIG. 1 illustrates generally at 10 an exhaust purification system of the invention as incorporated in the exhaust system of an internal combustion engine such for example as a diesel engine. The exhaust system may be considered as including an exhaust conduit 1 through which the engine discharges exhaust gas into the purification system 10 which discharges exhaust gas into a connecting conduit 2 which carries it to a sound attenuating muffler (not shown) that discharges into a tailpipe (not shown) that conducts the gas to the atmosphere.

The purification system 10 includes trap and burner casings 13 and 18 which are secured to form an outer shell 12 extending between the exhaust conduit 1 and the connecting conduit 2. The burner casing 18 has at its inlet a flange **18*a* which is bolted to the exhaust conduit 1 and has at its outlet a flange 18*b* which defines an outlet opening edge. The trap casing 13 has at its inlet a flange 13*b* which is bolted to the flange 18*b* of the burner casing 18. The trap casing 13 has an outlet connected to the connecting conduit 2**.

A trap or particle filter element 14 is supported inside and on the inner surface of the trap casing 13 by a mounting system 15 that may includes a buffer member. The trap element 14 has a honeycomb structure in which a first multiplicity of passageways closed at their inlet ends and a second multiplicity of passageways closed at their outlet ends are arranged alternatively so that exhaust particles can be collected therein while exhaust gas passes through the walls of the adjacent passageways.

A regenerative burner, which is generally designated at 20, is located inside the burner casing 18 and is actuated to burn the exhaust particles collected in the trap element 14 so as to regenerate the trap element 14 when a regeneration requirement occurs; that is, when the amount of exhaust particles collected in the trap element 14 reaches a predetermined value.

Figure 2:
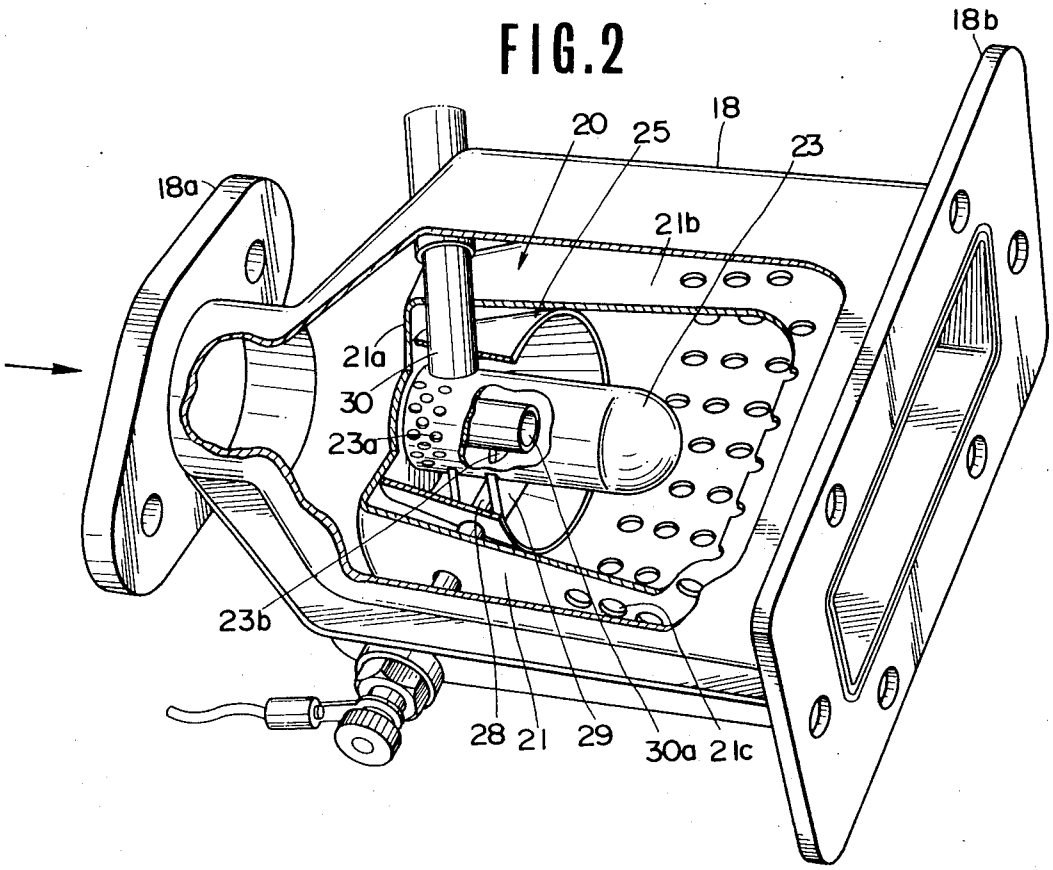
FIG. 2 is an enlarged perspective partially cutaway view of the regenerative burner of FIG. 1.

As best shown in FIG. 2, the regenerative burner 20 includes a combustion liner 21 fixed to the burner casing 18 to define a combustion chamber 22 therein. The support member 21 is shown as having an end wall 21*a* and a tubular side wass 21*b* to define on its downstream side a combustion chamber 22 which diverges away from the end wall and opens into the trap casing 13. The flared side wall terminates in an outlet opening edge which is secured to the outlet opening edge of the burner casing 18. The liner 21 is formed in its side wall near the outlet opening edge with a number of holes 21*c* so as to permit flow of exhaust gas from the exhaust conduit 1 through the combustion chamber 22 to the trap casing 13. A cylindrical cup-shaped member 23 is secured at its one end to the liner end wall 21*a* and extends into the combustion chamber 22 to define a reverse-flow evaporation chamber 24 therein with the other end thereof being closed. The hollow member 23 has a side wall formed with a number of flame or slits 23*a* to permit flow of an air-fuel mixture from the evaporation chamber 24 to the combustion chamber 22. The cup 24 is also formed in its side wall intermediate its ends with a downwardly facing opening 23*b*. A flame holder 25 is disposed in surrounding relationship about the side wall of the cup 23 but is spaced apart therefrom. The flame holder 25 is shown as a flared tube secured at its one end on the liner end wall 21*a* and at the other end opens into the combustion chamber 22. A glow plug 28, which is shown as extending through the flame holder 25, is located just below the opening 23*b* of the housing 23 for igniting fuel droplets that fall through the opening 23*b*. A pair of cover seal plates 29 is disposed on the opposite sides of the glow plug 28.

A mixture supply conduit 30 extends through the burner casing 18, the liner 21, the flame holder 25, and the cup 23 into the evaporation chamber 24 beyond the position of the opening 23*b* and has one end terminating in a discharge outlet 30*a* which opens into the evaporation chamber 24 toward the housing closed end so that the discharged mixture flow reverses in direction.

Referring back to FIG. 1, the mixture conduit 30 communicates through a three-way valve 31 with the outlet side of an air pump 32 and also through a fuel injection valve 33 to a fuel pump 34 which is actuated to supply fuel from a fuel reservoir 35 to the fuel injection valve 33 when a relay controlled switch 36 is closed on command from a control unit 50 to connect the fuel pump 22 to a battery 40.

The fuel injection valve 33 receives fuel injection pulses from the control unit 50 and operates to supply fuel into the mixture conduit 30. The three-way valve 32 is movable between two positions, the first position resulting in connection between the inlet and outlet sides 32*a* and 32*b* of the air pump 23. The second position is encountered on command from the control unit 50 to disconnect the inlet and outlet sides 32*a* and 32*b* of the air pump 32 and at the same time connect the air pump outlet 32*b* to the mixture conduit 30 so as to supply air into the mixture conduit 30 where it is mixed with the fuel supplied through the fuel injection valve 33.

The glow plug 28 is actuated to ignite the mixture discharged into the reverse-flow evaporation chamber 24 and create flames at the flame holes 23*a* when a relay controlled switch 38 is closed, on command from the control unit 50, to connect the glow plug 28 to the battery 40.

A first pressure sensor 41, which includes a diaphragm device and a piezoelectric element shown as a potentiometer, measures the pressure (P1) on the inlet side of the trap element 14 within the trap casing 13 and provides a voltage signal indicative of the measured pressure (P1) to the control unit 50. Similarly, a second pressure sensor 42, which includes a diaphragm device and a piezoelectric element shown as a potentiometer, measures the pressure (P2) on the outlet side of the trap element 14 within the trap casing 13 and provides a voltage signal indicative of the measured pressure (P2) to the control unit 50. The use of these diaphragm devices can minimize the influence of exhaust gas heat on the pressure measurements.

The control unit 50 is connected to the battery 40 through an engine key switch 45. The control unit 50 determines a regeneration requirement, which occurs when the amount of the exhaust particles collected in the trap element 14 reaches a predetermined value, based upon the values of the voltage signals from the first and second pressure sensors 41 and 42. When a regeneration requirement occurs, the control unit 50 operates the regenerative burner 20 to regenerate the trap element 14 by immediately actuating the glow plug 28 while actuating the fuel pump 34, operating the fuel injection valve 33, and changing the three-way valve 31 to the second position so as to supply an air-fuel mixture to the reverse-flow evaporation chamber 24 with a delay during which the glow plug 28 increases its temperature to a level sufficient to ignite a part of the supplied fuel. The supplied fuel still remains liquified and falls in drops on the glow plug 28 since a diesel engine discharges relatively low-temperature exhaust gas and employs light-oil fuel that evaporates only at relatively high temperature (at least 300° C.).

The ignited fuel droplets serves to ignite the most of the air-fuel mixture blowing off from the flame holes 32*a* and reaching the glow plug 28. The guide tube 25 promotes flames and directed them into the combustion chamber 22 to thereby heat the exhaust gas which flows through the holes 21*c* into the combustion chamber 22. The heated exhaust gas flows into the trap casing 13 where it burns the exhaust particles collected in the trap element 14 so as to regenerate the trap element.

After the ignition of the supplied air-fuel mixture, the flame held in the flame holder 25 heats the cup 23 to promote evaporation of the fuel flowing through the evaporation chamber 24. Thus, the control unit 50 generates a command to cause the relay switch 38 to disconnect the glow plug 28 from the battery 40 upon completion of the ignition of the supplied air-fuel mixture. When a predetermined time elapses after the glow plug 28 is deenergized, the control unit 50 provides a command to cause the three-way valve 31 to change to its first position so as to terminate the supply of air to the mixture conduit 30 and also commands to cause the fuel injection valve 33 to terminate its operation and at the same time causes the relay switch 36 to disconnect the fuel pump 34 from the battery so as to terminate the supply of fuel to the mixture conduit 30.

In this embodiment, the mixture conduit 30 extends through the flame holder 25 and the cup 23 into the evaporation chamber 24 and has a portion (30*b*) exposed to the flame held in the flame holder 25 to further promote fuel evaporation during a trap regenerating operation. That is, the fuel, which is flowing through the mixture conduit 30, is heated in the flame holder 25 and then is heated in the evaporation chamber 24 to be evaporated completely even under low speed and low load conditions where the temperature of exhaust gas is relatively low and the amount of fuel required for the regenerative burner 20 is relatively great. The complete fuel evaporation provides improved burner combustion efficiency to improve trap regeneration efficiency and also creates stable flame in the flame holder 25 to provide uniform trap regeneration and avoid burner burnout resulting from partially strengthened flame.

Figure 3:
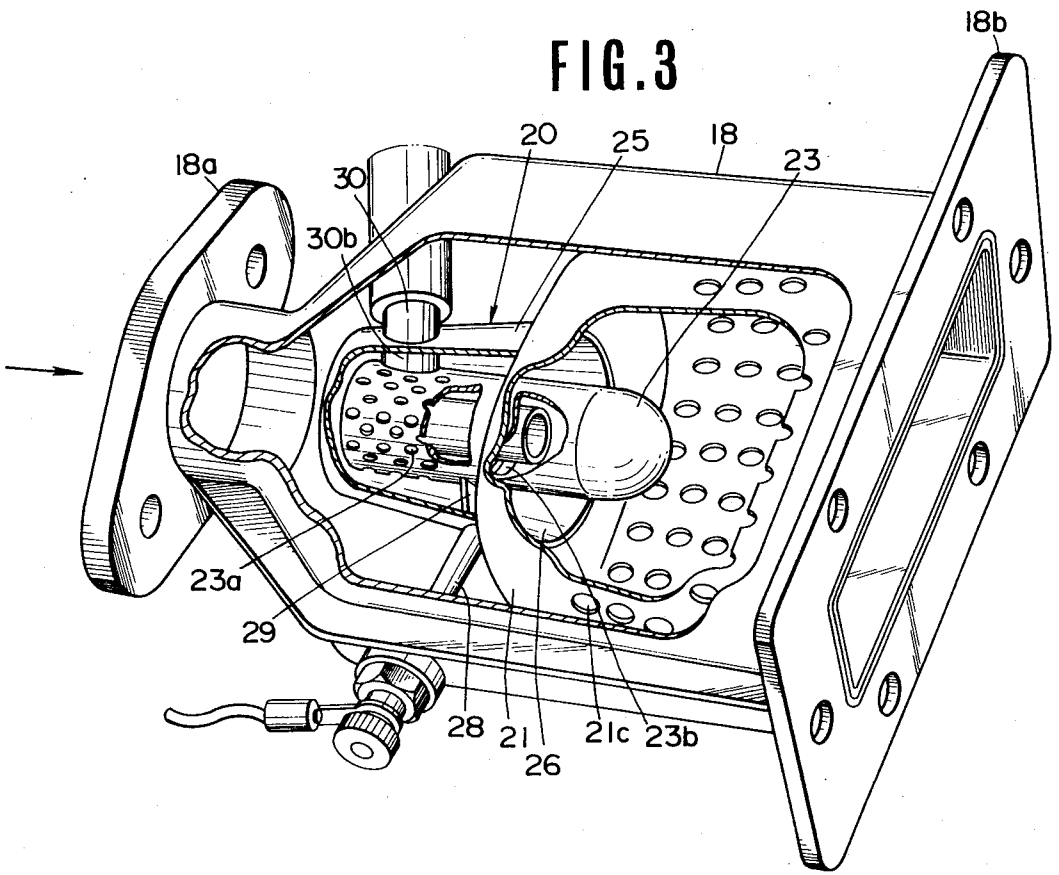
FIG. 3 is an enlarged perspective partially cutaway view showing a second embodiment of the invention.

Referring to FIG. 3, there is illustrated another embodiment of the present invention which differs from the first embodiment in the structure of the flame holder. Parts in FIG. 3 which are like those in FIG. 2 have been given the same reference character. Parts which perform the same function but are slightly different in form have been given the same reference character with a prime suffix.

In this embodiment, the support member 21 has an end wall formed therein with an opening edge 21*d*. The flame holder 25' is shown as having an end wall 25'*a* and a flared side wall 25'*b* to define on its downstream side a flame chamber 26 which diverges away from the end wall 25'*a* and opens into the combustion chamber 22. The flared side wall 25'*b* terminates in an outlet opening edge which is secured to the opening edge 21*d* of the liner 21. The cup 23 is secured at its one end to the flame holder end wall 25'*a* and extends through the flame chamber 26 into the combustion chamber 22 to define a reverse-flow evaporation chamber 24 therein with the other end thereof being closed. The cup 23 is shown as having a cylindrical side wall formed with a several lines of flame holes 23*a* equally spaced on each line to provide stable and uniform flame.

The mixture conduit 30 extends through the burner casing 18, the flame holder 25', and the cup 23 into the evaporation chamber 24 beyond the position of the opening 23*b* and has one end terminating in a discharge outlet 30*a* which opens into the evaporation chamber 24 toward the housing closed end so that the discharged mixture flow reverses in direction. The mixture conduit 30 extends into the evaporation chamber 24 through an aperture formed in the housing side wall and turns therein toward the housing closed end.

In the second embodiment, the mixture conduit 30 extends through the flame holder 25' and the cup 23 into the evaporation chamber 24 and has a portion exposed to the flame held in the flame chamber 26 to further promote fuel evaporation during a trap regenerating operation. The fuel, which is flowing through the mixture conduit 30, is heated in the flame chamber 26 and then is heated in the evaporation chamber 24 to be evaporate completely over the entire range of engine operating conditions as described in connection with the first embodiment of FIGS. 1 and 2.

Figure 4:
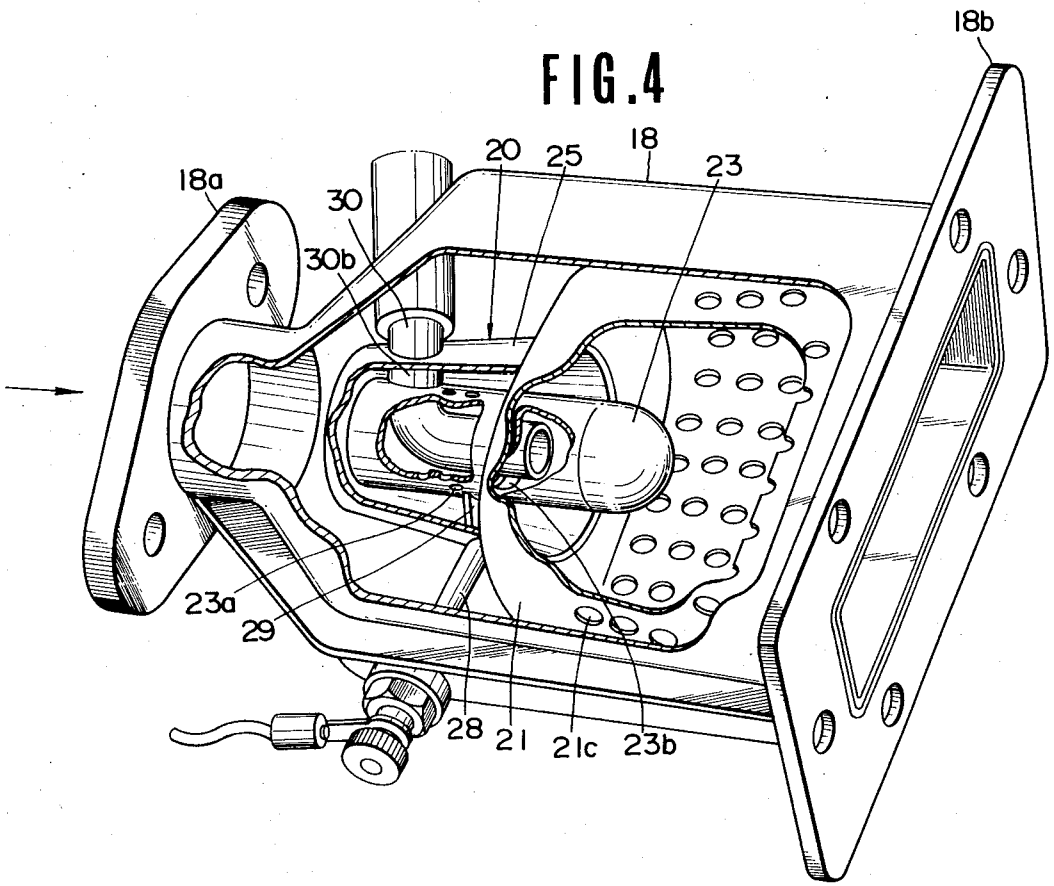
FIG. 4 is an enlarged perspective partially cutaway view showing a modified form of the regenerative burner of FIG. 3.

Referring to FIG. 4, there is illustrated a modified form of the embodiment of FIG. 3 which differs from the second embodiment only in that the flame holes 23*a* are formed in the housing side wall upstream of the aperture through which the mixture conduit 30 extends into the evaporation chamber 24. The flame holes 23*a* are arranged in several peripheral lines and equally spaced on each line. This modification is effective to eliminate variations in the amount of air-fuel mixture discharged through the respective flame holes 23*a* and create stable and uniform flame in the flame holder 25'.

Although the present invention has been described in connection with specific embodiments thereof, it is evident that many alternatives, modifications and variations will be apparent to those skilled in the art. Accordingly, it is intended to embrace all alternatives, modifications and variations that fall within the broad scope of the appended claims.

What is claimed is:

1. An exhaust purification apparatus for use in an internal combustion engine having an exhaust conduit through which exhaust particles are discharged together with exhaust gas to the atmosphere, including an outer shell having an inlet connected to said exhaust conduit and an outlet connected to the atmosphere, said outer shell containing a trap element and a regenerative burner located upstream of said trap element, said regenerative burner comprising:

(a) a liner member arranged within said outer shell and defining a combustion chamber within said liner member, said liner being closed at its upstream end and open at its downstream end and adapted to direct the flow of exhaust gas from said exhaust conduit through said combustion chamber to said trap element;

(b) a cylindrical hollow member fixed to said liner and extending within said combustion chamber to define an evaporation chamber within said hollow member, said hollow member having closed ends and the cylindrical side wall of said hollow member being formed with flame holes or slits located adjacent the upstream end of said hollow member to permit fluid flow from said evaporation chamber into said combustion chamber;

(c) a mixture conduit having an end terminating in a discharge outlet for supplying an air-fuel mixture into said evaporation chamber, said mixture conduit having a first portion extending through said liner member and said combustion chamber and being exposed to flames formed in said combustion chamber to preheat a mixture flowing therethrough and a second portion extending from said combustion chamber through the cylindrical side wall of said hollow member and into said evaporation chamber to the downstream end thereof to deliver the preheated mixture thereto;

(d) a glow plug for igniting the mixture supplied into said evaporated chamber when actuated; and (e) a control unit responsive to a regeneration requirement for actuating said glow plug and supplying an air-fuel mixture into said evaporation chamber through said mixture conduit.

2. The apparatus claimed in claim 1, wherein said flame holes formed in said hollow member cylindrical side wall, are arranged in lines and equally spaced on each of said lines.

3. The apparatus as claimed in claim 1, wherein said liner comprises first and second tubular casings secured to each other, said first casing being closed at its upstream end and opening at its downstream end into said second casing, said second casing being open at its downstream end and adapted to direct the flow of exhaust gas from said conduit through said combustion chamber to said trap element.

4. The apparatus claimed in claim 3, wherein said hollow member is secured to said first casing of the liner and extends into said second casing, said hollow member having a cylindrical side wall.

5. The apparatus claimed in claim 4, wherein said flame holes formed in said hollow member cylindrical side wall are arranged in lines and equally spaced on each of said lines.

6. The apparatus defined by claim 1, further including a flame holder member arranged in said combustion chamber between said liner member and said hollow member and spaced from said hollow member to define a flame chamber between the flame holder member and the hollow member.

7. The apparatus defined by claim 6, wherein the second portion of said mixture conduit extends from said combustion chamber through said flame holder member, said flame chamber and the cylindrical side wall of said hollow member, respectively.

* * * * *

UNITED STATES PATENT OFFICE

CERTIFICATE OF CORRECTION

Patent No. 4,662,172 Dated May 5, 1987

Inventor(s) Motohiro SHINZAWA; and Shoji USHIMURA

It is certified that error appears in the above-identified patent and that said Letters Patent are hereby corrected as shown below:

Cover page, item [30] should be inserted as follows:

--[30] Foreign Application Priority Data
Mar. 18, 1983 [JP] Japan ..... 58-38324--

Signed and Sealed this

Thirteenth Day of October, 1987

*Attest:*

DONALD J. QUIGG

*Attesting Officer*

*Commissioner of Patents and Trademarks*